US008677964B2

(12) United States Patent
Shin

(10) Patent No.: US 8,677,964 B2
(45) Date of Patent: Mar. 25, 2014

(54) VARIABLE VALVE LIFT APPARATUS

(75) Inventor: Bosung Shin, Suwon (KR)

(73) Assignees: Hyundai Motor Company, Seoul (KR); Kia Motors Corporation, Seoul (KR)

( * ) Notice: Subject to any disclaimer, the term of this patent is extended or adjusted under 35 U.S.C. 154(b) by 315 days.

(21) Appl. No.: 13/166,554

(22) Filed: Jun. 22, 2011

(65) Prior Publication Data

US 2012/0132161 A1 May 31, 2012

(30) Foreign Application Priority Data

Nov. 30, 2010 (KR) ..... 10-2010-0120917

(51) Int. Cl.
*F01L 1/18* (2006.01)

(52) U.S. Cl.
USPC ..... 123/90.45; 123/90.44; 123/90.46; 123/90.39

(58) Field of Classification Search
USPC ..... 123/90.39, 90.44, 90.45, 90.46
See application file for complete search history.

(56) References Cited

FOREIGN PATENT DOCUMENTS

| | | | |
|---|---|---|---|
| JP | 10-131727 | A | 5/1998 |
| JP | 2007-138787 | A | 6/2007 |
| JP | 3996751 | B2 | 8/2007 |
| JP | 2010-196642 | A | 9/2010 |
| KR | 10-2008-0023036 | A | 3/2008 |

*Primary Examiner* — Ching Chang

(74) *Attorney, Agent, or Firm* — Morgan, Lewis & Bockius LLP

(57) ABSTRACT

A variable valve lift apparatus includes a cam, a swing arm of which one end thereof a valve is connected to and the swing arm contacting the cam, a support portion selectively supporting the other end of the swing arm, a hydraulic lash adjuster of which an oil supply hole and an oil exhaust hole thereto, and selectively supporting the swing arm according to oil supplying thereto or oil exhausting therefrom, a check valve selectively opening the oil exhaust hole and a control portion controlling the check valve for the check valve to selectively open the oil exhaust hole.

8 Claims, 5 Drawing Sheets

VARIABLE VALVE LIFT APPARATUS

CROSS-REFERENCE TO RELATED APPLICATION

This application claims priority to and the benefit of Korean Patent Application No. 10-2010-0120917 filed Nov. 30, 2010, the entire contents of which application incorporated herein for all purposes by this reference.

BACKGROUND OF INVENTION

1. Field of Invention

The present invention relates to a variable valve lift apparatus. More particularly, the present invention relates to a variable valve lift apparatus which may vary valve lift according to engine operation condition with simple scheme.

2. Description of Related Art

Generally, an automotive engine includes a combustion chamber in which fuel burns to generate power. The combustion chamber is provided with an intake valve for supplying a gas mixture containing the fuel and an exhaust valve for expelling the burned gas. These intake and exhaust valves open and close the combustion chamber by a valve lift apparatus connected to a crankshaft.

A conventional valve lift apparatus has a fixed valve lift amount using a cam formed in a predetermined shape. Therefore, it is impossible to adjust the amount of a gas that is being introduced or exhausted. Therefore, the engine does not run at its optimum state for various driving ranges.

For example, if a valve lift apparatus is designed to optimally respond to a low driving speed, the valve open time and amount are not sufficient for a high speed driving state. On the contrary, when the valve lift apparatus is designed to optimally respond to a high speed driving state, an opposite phenomenon occurs in the low speed driving state.

The information disclosed in this Background of the Invention section is only for enhancement of understanding of the general background of the invention and should not be taken as an acknowledgement or any form of suggestion that this information forms the prior art already known to a person skilled in the art.

SUMMARY OF INVENTION

Various aspects of the present invention has been made in an effort to provide a variable valve lift apparatus having advantages of varying valve lift according to engine operation condition with simple scheme.

One aspect of the present invention is directed to a variable valve lift apparatus that may include a cam, a swing arm of which one end thereof a valve is connected to and the swing arm contacting the cam, a support portion selectively supporting the other end of the swing arm, a hydraulic lash adjuster of which an oil supply hole and an oil exhaust hole thereto, and selectively supporting the swing arm according to oil supplying thereto or oil exhausting therefrom, a check valve selectively opening the oil exhaust hole and a control portion controlling the check valve for the check valve to selectively open the oil exhaust hole.

The hydraulic lash adjuster may further include a housing, a plunger which is disposed to the housing for supporting the swing arm and a spring which is disposed within the housing for elastically supporting the plunger.

The check valve may include a check valve head which is disposed within the housing for selectively blocking the oil exhaust hole and a check valve body which is connected to the check valve head and protruded through the oil exhaust hole.

The control portion may selectively push the check valve body for the check valve head to open the oil exhaust hole.

The control portion may include a control portion shaft which is disposed to an engine along vertical direction to the check valve body, wherein, the control portion shaft includes a first body having a first diameter and a second body having a second diameter, and the first body and the second body selectively contact to the check valve body.

A control portion chamber and a control portion oil hydraulic line may be formed to the engine and the control portion oil hydraulic line selectively supplies oil to the control portion chamber or releases oil from the control portion chamber, a shaft head may be protruded formed to the control portion shaft, the shaft head may be disposed to the control portion chamber, and the control portion shaft may be movable along the length direction thereof according to oil supply and exhaust of the control portion oil hydraulic line.

Another aspect of the present invention is directed to a variable valve lift apparatus that may include a cam, a swing arm of which one end thereof a valve is connected to and the swing arm contacting the cam, a support portion selectively supporting the other end of the swing arm, a housing of which an oil supply hole and an oil exhaust hole are formed thereto, a plunger which is disposed to the housing for supporting the swing arm, a spring which is disposed within the housing for elastically supporting the plunger, a check valve selectively opening the oil exhaust hole and a control portion controlling the check valve for the check valve to selectively open the oil exhaust hole.

The check valve may include a check valve head which is disposed within the housing for selectively blocking the oil exhaust hole and a check valve body which is connected to the check valve head and protruded through the oil exhaust hole.

The control portion may selectively push the check valve body for the check valve head to open the oil exhaust hole.

The control portion may include a control portion shaft which is disposed to an engine along vertical direction to the check valve body, wherein, the control portion shaft includes a first body having a first diameter and a second body having a second diameter, and the first body and the second body selectively contact to the check valve body.

A control portion chamber and a control portion oil hydraulic line may be formed to the engine and the control portion oil hydraulic line selectively supplies oil to the control portion chamber or releases oil from the control portion chamber, a shaft head may be protruded formed to the control portion shaft, the shaft head may be disposed to the control portion chamber, and the control portion shaft may be movable along the length direction thereof according to oil supply and exhaust of the control portion oil hydraulic line.

The variable valve lift apparatus according to various aspects of the present invention may vary valve lift according to engine operation condition with simple scheme.

Also, manufacturing cost may be reduced with simple scheme and relative number of operating members is small and thus relative dynamic load is low and engine efficiency may be enhanced.

The methods and apparatuses of the present invention have other features and advantages which will be apparent from or are set forth in more detail in the accompanying drawings, which are incorporated herein, and the following Detailed Description, which together serve to explain certain principles of the present invention.

DETAILED DESCRIPTION

Reference will now be made in detail to various embodiments of the present invention(s), examples of which are illustrated in the accompanying drawings and described below. While the invention(s) will be described in conjunction with exemplary embodiments, it will be understood that present description is not intended to limit the invention(s) to those exemplary embodiments. On the contrary, the invention (s) is/are intended to cover not only the exemplary embodiments, but also various alternatives, modifications, equivalents and other embodiments, which may be included within the spirit and scope of the invention as defined by the appended claims.

Figure 1:
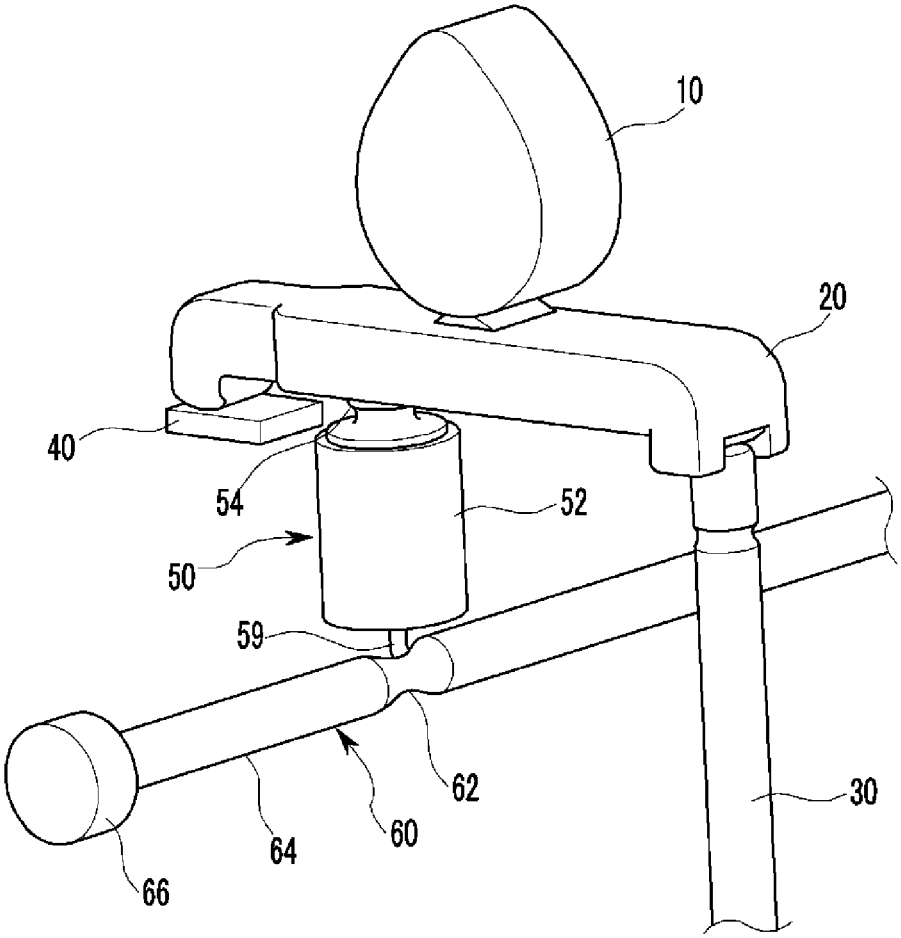
FIG. 1 is a perspective view showing an exemplary variable valve lift apparatus according to the present invention.
Figure 2:
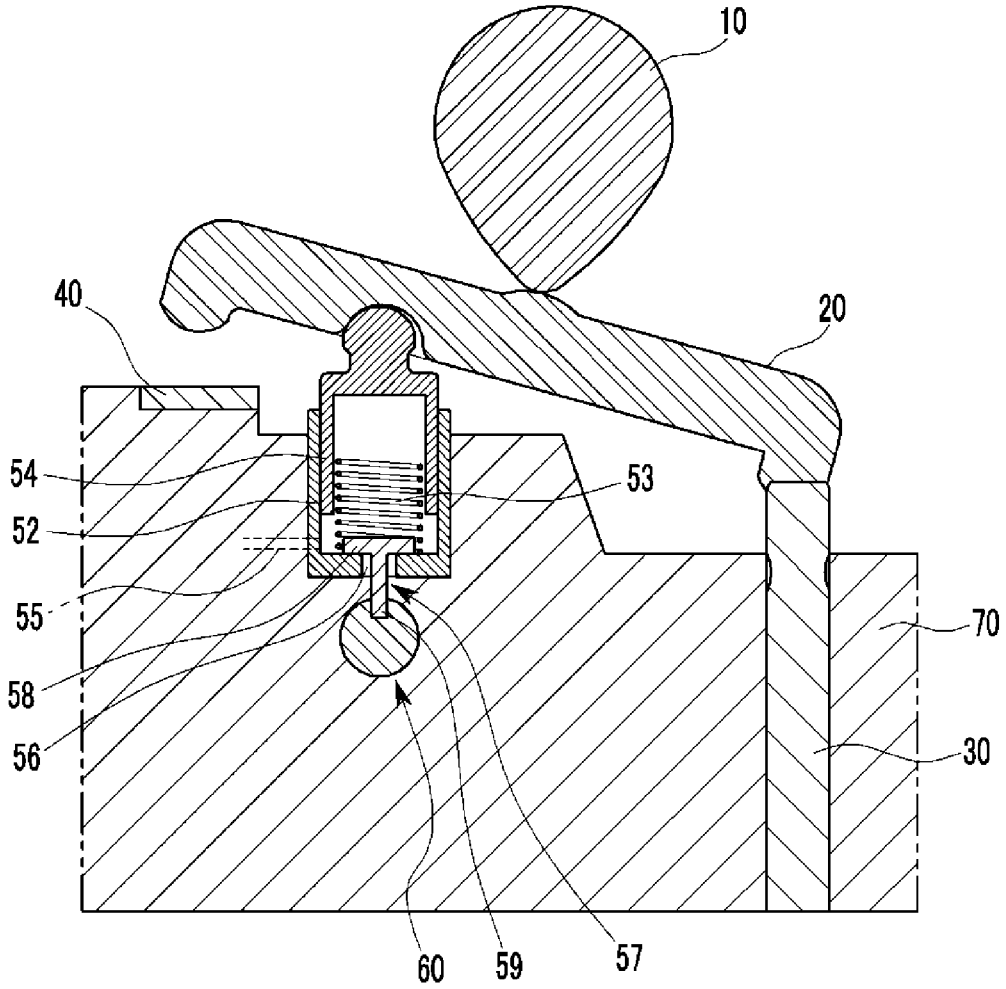
FIG. 2 and FIG. 3 are cross-sectional views showing operation of an exemplary variable valve lift apparatus according to the present invention in high lift mode.
Figure 3:
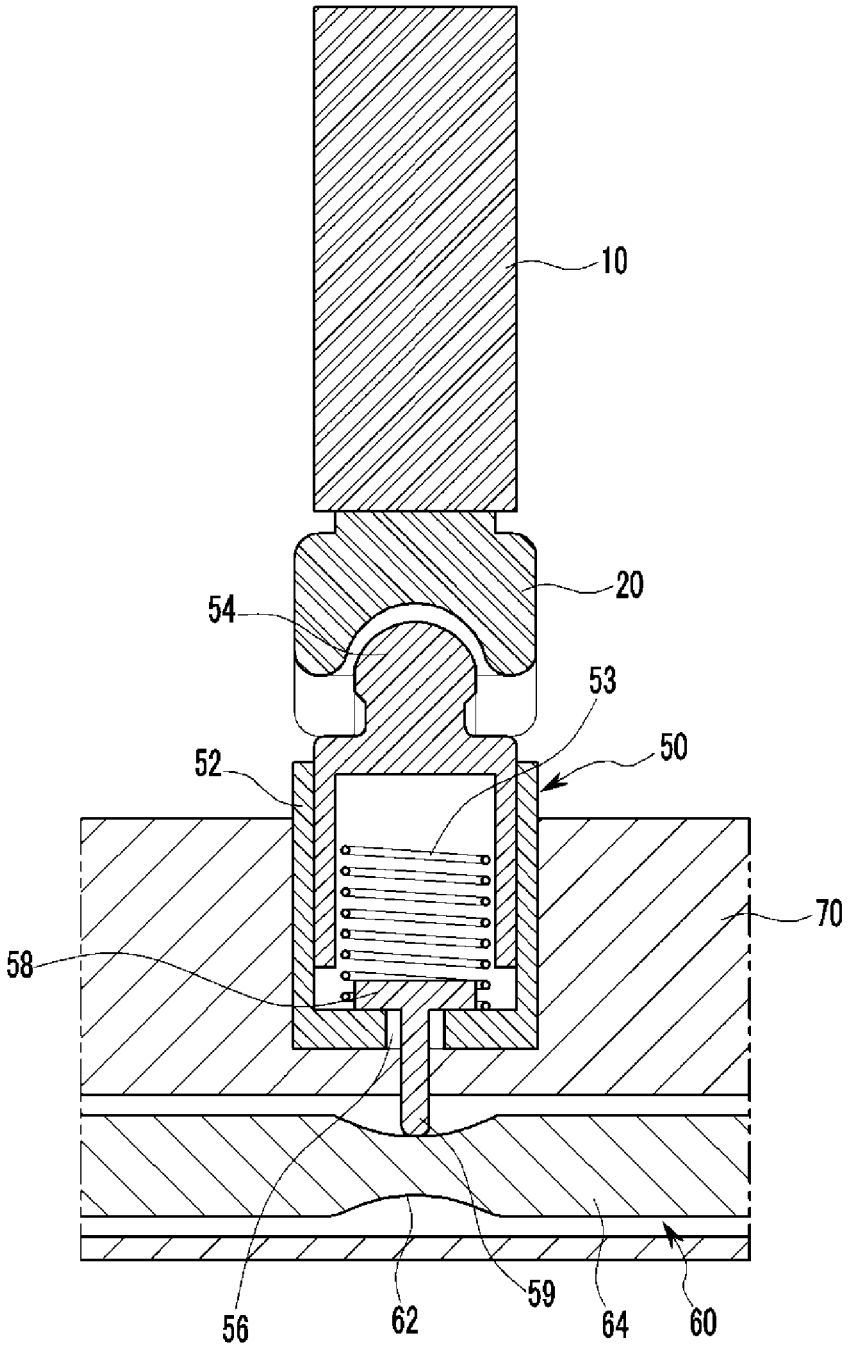

With reference to the drawing figures, FIG. 1 illustrates a variable valve lift apparatus according to various embodiments of the present invention, and FIG. 2 and FIG. 3 are cross-sectional views showing operation of such a variable valve lift apparatus according to the present invention in high lift mode.

The variable valve lift apparatus according to various embodiments of the present invention generally includes a cam 10, a swing arm 20 of which one end thereof a valve 30 is connected to and the swing arm 20 contacting the cam 10, a support portion 40 selectively supporting the other end of the swing arm 20, a hydraulic lash adjuster 50 of which an oil supply hole 55 and an oil exhaust hole 56 thereto, and selectively supporting the swing arm 20 according to oil supplying thereto or oil exhausting therefrom, a check valve 57 selectively opening the oil exhaust hole 56 and a control portion controlling the check valve 57 for the check valve 57 to selectively open the oil exhaust hole 56.

The hydraulic lash adjuster 50 further includes a housing 52, a plunger 54 which is disposed to the housing 52 for supporting the swing arm 20 and a spring 53 which is disposed within the housing 52 for elastically supporting the plunger 54.

The check valve 57 includes a check valve head 58 which is disposed within the housing 52 for selectively blocking the oil exhaust hole 56 and a check valve body 59 which is connected to the check valve head 58 and protruded through the oil exhaust hole 56.

The control portion selectively pushes the check valve body 59 for the check valve head 58 to open the oil exhaust hole 56.

The control portion includes a control portion shaft 60 which is disposed to an engine 70 along vertical direction to the check valve body 59, wherein, the control portion shaft 60 includes a first body 62 having a first diameter and a second body 64 having a second diameter, and the first body 62 and the second body 64 selectively contact to the check valve body 59.

In this case, the engine 70 includes a cylinder head, a valve train and so on in an otherwise conventional manner.

Figure 4:
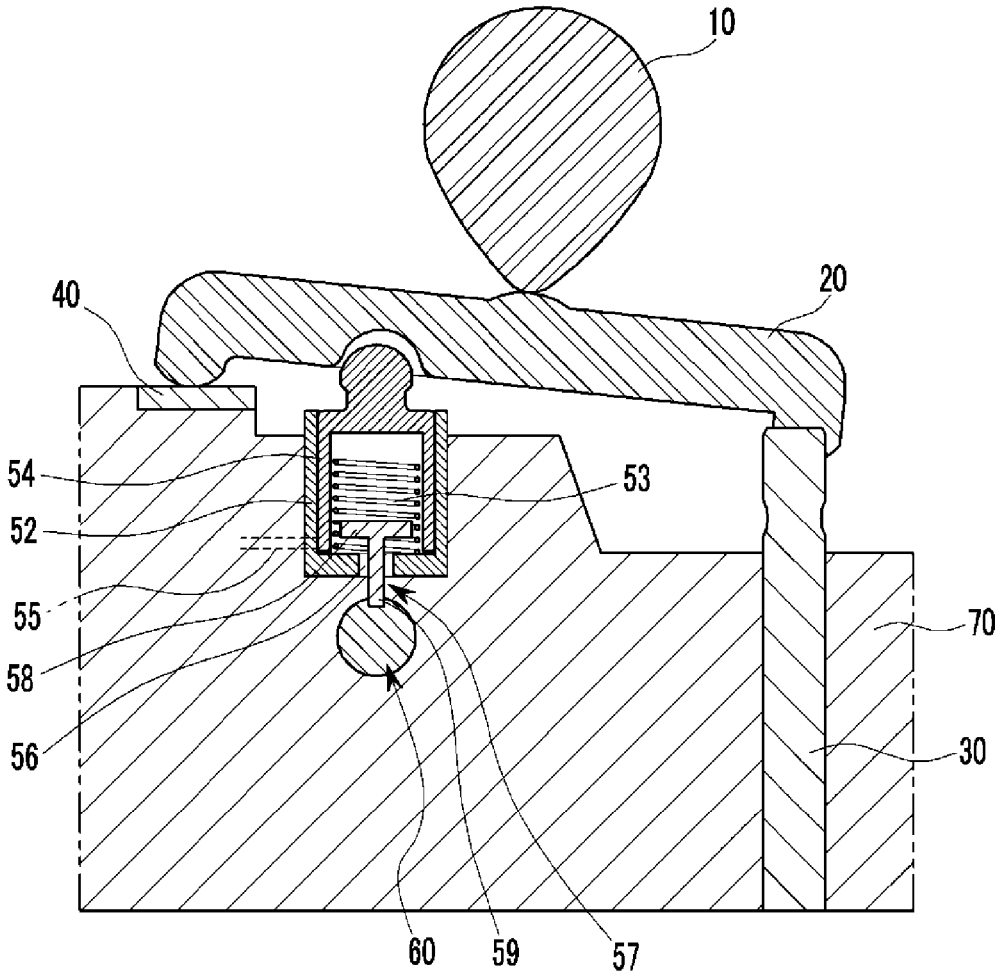
FIG. 4 and FIG. 5 are cross-sectional views showing operation of an exemplary variable valve lift apparatus according to the present invention in low lift mode.
Figure 5:
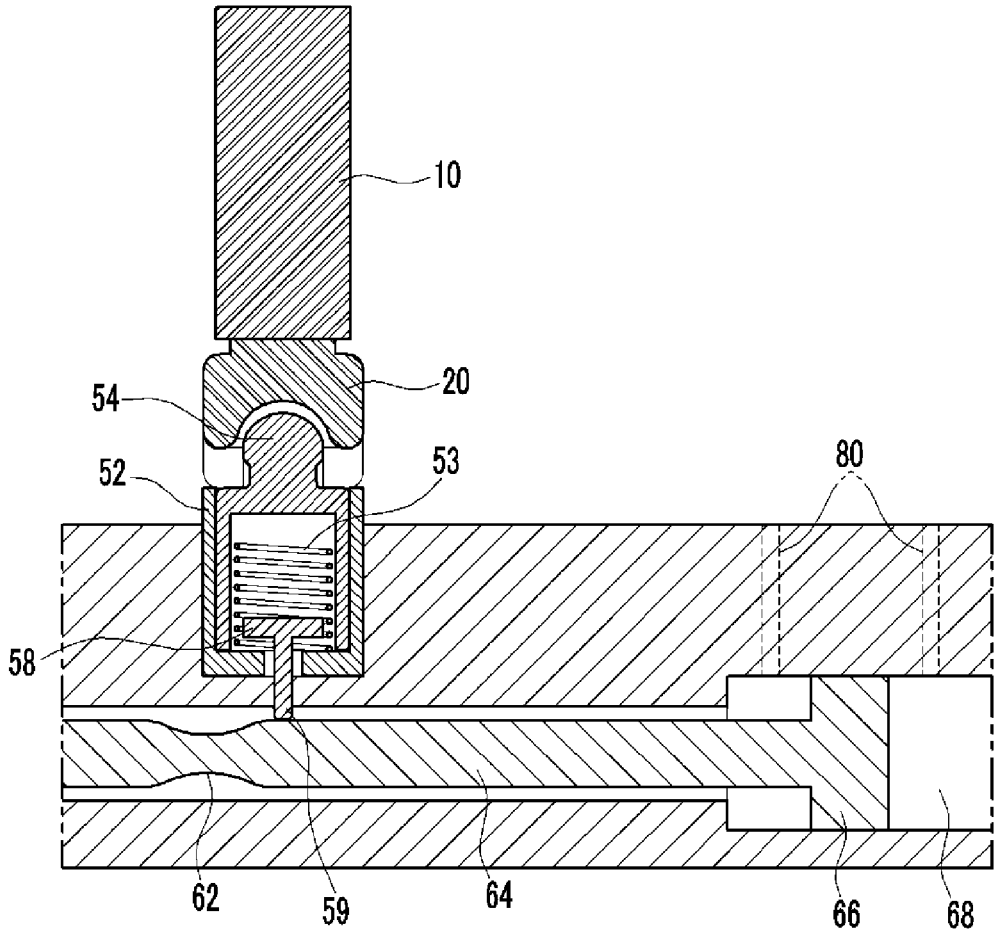

FIG. 4 and FIG. 5 are cross-sectional views showing operation of a variable valve lift apparatus according to various embodiments of the present invention in low lift mode.

Referring to FIG. 4 and FIG. 5, a control portion chamber 68 and a control portion oil hydraulic line 80 are formed to the engine 70 and the control portion oil hydraulic line 80 selectively supplies oil to the control portion chamber 68 or releases oil from the control portion chamber 68, a shaft head 66 is protruded formed to the control portion shaft 60, the shaft head 66 is disposed to the control portion chamber 68, and the control portion shaft 60 is movable along the length direction thereof according to oil supply and exhaust of the control portion oil hydraulic line 80.

Hereinafter, referring to FIG. 1 to FIG. 3, operations of the variable valve lift apparatus according to various embodiments of the present invention in high lift mode will be described.

In the high lift mode, oil is supplied through the oil supply hole 55, as shown in FIG. 2, and the swing arm 20 pivots around the plunger 54.

The check valve body 59, as shown in FIG. 3, contacts to the first body 62 and the check valve head 58 blocks the oil exhaust hole 56.

Hereinafter, referring to FIG. 4 and FIG. 5, operations of the variable valve lift apparatus according to various embodiments of the present invention in low lift mode will be described.

In the lift mode, an ECU (engine control unit) controls oil supplying or releasing through the control portion oil hydraulic line 80 and thus the control portion shaft 60 moves along the length direction thereof. In this case, operations of the ECU and so on are relatively conventional and generally known and thus detail description will be omitted.

And then, the second body 64 contacts to the check valve body 59 and the oil exhaust hole 56 is opened.

And thus, as shown in FIG. 4, pressure in the hydraulic lash adjuster 50 is released and the swing arm 20 pivots around the support portion 40 and lost motion of the plunger 54 occurs.

In this case the support portion 40 may be a separate element or a part of the engine 70.

As describe above, lift of the valve 30 is reduced in the low lift mode.

If operation mode has to be changed to the high lift mode according to engine operation conditions, oil is supplied or exhausted through the control portion oil hydraulic line 80, the control portion shaft 60 moves opposite direction, and the first body 62 contacts to the check valve body 59.

And then the hydraulic lash adjuster 50 is filled with oil through the oil supply hole 55 and the variable valve lift apparatus is operated in the high lift mode.

The foregoing descriptions of specific exemplary embodiments of the present invention have been presented for purposes of illustration and description. They are not intended to be exhaustive or to limit the invention to the precise forms disclosed, and obviously many modifications and variations are possible in light of the above teachings. The exemplary embodiments were chosen and described in order to explain certain principles of the invention and their practical application, to thereby enable others skilled in the art to make and utilize various exemplary embodiments of the present invention, as well as various alternatives and modifications thereof. It is intended that the scope of the invention be defined by the Claims appended hereto and their equivalents.

What is claimed is:

1. A variable valve lift apparatus comprising:

a cam;

a swing arm having one end operably connected to a valve, wherein the swing arm contacts the cam;

a support portion selectively supporting another end of the swing arm;

a hydraulic lash adjuster of which an oil supply hole and an oil exhaust hole thereto, and selectively supporting the swing arm according to oil supplying thereto or oil exhausting therefrom;

a check valve selectively opening the oil exhaust hole; and a control portion controlling the check valve for the check valve to selectively open the oil exhaust hole, wherein the hydraulic lash adjuster further comprises:

a housing;

a plunger which is disposed to the housing for supporting the swing arm; and a spring which is disposed within the housing for elastically supporting the plunger; and wherein the check valve comprises:

a check valve head which is disposed within the housing for selectively blocking the oil exhaust hole; and a check valve body which is connected to the check valve head and protruded through the oil exhaust hole.

2. The variable valve lift apparatus of claim 1, wherein the control portion selectively pushes the check valve body for the check valve head to open the oil exhaust hole.

3. The variable valve lift apparatus of claim 2, wherein the control portion comprises a control portion shaft which is disposed to an engine along vertical direction to the check valve body, wherein, the control portion shaft includes a first body having a first diameter and a second body having a second diameter, and the first body and the second body selectively contact to the check valve body.

4. The variable valve lift apparatus of claim 3, wherein:

a control portion chamber and a control portion oil hydraulic line are formed to the engine and the control portion oil hydraulic line selectively supplies oil to the control portion chamber or releases oil from the control portion chamber;

a shaft head is protruded formed to the control portion shaft;

the shaft head is disposed to the control portion chamber; and the control portion shaft is movable along the length direction thereof according to oil supply and exhaust of the control portion oil hydraulic line.

5. A variable valve lift apparatus comprising:

a cam;

a swing arm having one end operably connected to a valve, wherein the swing arm contacts the cam;

a support portion selectively supporting another end of the swing arm;

a housing of which an oil supply hole and an oil exhaust hole are formed thereto;

a plunger which is disposed to the housing for supporting the swing arm;

a spring which is disposed within the housing for elastically supporting the plunger;

a check valve selectively opening the oil exhaust hole; and a control portion controlling the check valve for the check valve to selectively open the oil exhaust hole, wherein the check valve comprises:

a check valve head which is disposed within the housing for selectively blocking the oil exhaust hole; and a check valve body which is connected to the check valve head and protruded through the oil exhaust hole.

6. The variable valve lift apparatus of claim 5, wherein the control portion selectively pushes the check valve body for the check valve head to open the oil exhaust hole.

7. The variable valve lift apparatus of claim 5, wherein the control portion comprises a control portion shaft which is disposed to an engine along vertical direction to the check valve body, wherein, the control portion shaft includes a first body having a first diameter and a second body having a second diameter, and the first body and the second body selectively contact to the check valve body.

8. The variable valve lift apparatus of claim 7, wherein:

a control portion chamber and a control portion oil hydraulic line are formed to the engine and the control portion oil hydraulic line selectively supplies oil to the control portion chamber or releases oil from the control portion chamber;

a shaft head is protruded formed to the control portion shaft;

the shaft head is disposed to the control portion chamber; and the control portion shaft is movable along the length direction thereof according to oil supply and exhaust of the control portion oil hydraulic line.

* * * * *